United States Patent [19]

Frohnert et al.

[11] 4,365,976

[45] Dec. 28, 1982

[54] PROCESS FOR SEPARATING DUST FROM DISTILLATION GASES

[75] Inventors: Heinz Frohnert, Bottrop; Klaus Steude, Dorsten, both of Fed. Rep. of Germany

[73] Assignee: Veba Oel Development, Inc., Gelsenkirchen-Buer, Fed. Rep. of Germany

[21] Appl. No.: 277,028

[22] Filed: Jun. 24, 1981

[30] Foreign Application Priority Data

Jun. 25, 1980 [DE] Fed. Rep. of Germany ..... 3023727

[51] Int. Cl.[3] ..... B03C 3/01; C10G 35/10

[52] U.S. Cl. ..... 55/4; 55/11; 208/161

[58] Field of Search ..... 55/4, 11, 135; 208/161, 208/162

[56] References Cited

U.S. PATENT DOCUMENTS

| | | | |
|---|---|---|---|
| 1,884,085 | 10/1932 | Miller | 55/4 |
| 2,356,717 | 8/1944 | Williams | 208/161 |
| 2,759,877 | 8/1956 | Eron | 208/161 |
| 2,886,518 | 5/1959 | Schulman et al. | 208/161 |
| 3,989,482 | 11/1976 | Ritzmann et al. | 55/11 |

*Primary Examiner*—David L. Lacey

*Attorney, Agent, or Firm*—Oblon, Fisher, Spivak, McClelland & Maier

[57] ABSTRACT

Dust is removed from distillation gases, particularly from gases from the distillation of oil shale, by electrostatic precipitation at temperatures above the dew point of the oil components, preferably between 470° and 550° C.

4 Claims, No Drawings

PROCESS FOR SEPARATING DUST FROM DISTILLATION GASES

BACKGROUND OF THE INVENTION

1. Field of the Invention

This invention relates to purification of exhaust gases from the distillation of oil shale, and more particularly to cleaning distillation gases from oil shale by using electrostatic precipitators.

2. Background of the Invention

In the distillation retorting of oil shale, depending on the particle size of the shale which is distilled and the method of distillation used, a greater or lesser amount of dust will be carried out of the distillation reactor together with the distillation gas and be present in the oil after subsequent cooling and condensation. The finer the shale is ground, the greater the amount of dust. Removing dust from the oil is very expensive and reduces the yield of oil.

Removal of dust from distillation gases by means of cyclone separators is known. However, this procedure has the disadvantage that fine dust can be only partially removed. When electrostatic precipitation is used to remove dust from combustion gases, the difference between the corona initiation voltage and the sparkover voltage decreases as the gas temperature increases. Furthermore, it has been found in the case of a number of dust-containing gases, e.g. exhaust gas from the preheating of finely ground cement raw mixes with furnace flue gases, that they cannot be cleaned in the temperature range 310° C. to 350° C. by electrostatic precipitation, but they can be cleaned at higher temperatures, e.g. 400° C. to 420° C. However, this is not the case with the reducing gases derived from distillation in the temperature range above 300° C.

A hot reducing gas produced by burning natural gas with an insufficient supply of air will contain the following components: nitrogen, carbon dioxide, carbon monoxide, water vapor, hydrogen, and methane, as well as smaller amounts of higher hydrocarbons. Such a gas cannot be cleaned by electrostatic precipitation in the temperature range which has to be used, because the difference between the corona initiation voltage and the sparkover voltage is too small.

Hence, a need has continued to exist for a method of removing dust from the distillation gases produced when oil shale is distilled.

SUMMARY OF THE INVENTION

Accordingly, it is an object of this invention to provide a method of removing dust from distillation gases in destructive distillation of oil shale.

A further object is to provide a method for cleaning distillation gases from oil shale by electrostatic precipitation.

Further objects of the invention will become apparent from the description of the invention which follows.

It has now been found that if a hot reducing gas produced by burning natural gas with an insufficient supply of air is used as the heat carrier for distillation of oil shale, whereby the evolved gases also contain condensable higher hydrocarbon materials, as well as oil shale dust, such a distillation gas can be successfully cleaned by electrostatic precipitation at temperatures from 300°–650° C.

DETAILED DESCRIPTION OF THE INVENTION AND PREFERRED EMBODIMENTS

Instead of a gas produced by burning natural gas with an insufficient air supply, the gas produced during the distillation can also be used as a heat carrier after it has been stripped of its condensable components. This gas may be heated either directly, through partial combustion with a gas containing oxygen, or indirectly in a heat exchanger, to a temperature above the distillation temperature. It is also possible to remove dust by electrostatic precipitation when the heat required for distillation is added in another manner, such as by means of heated solid materials, through the walls of the reactor, by partial combustion of carbon remaining on the shale, etc., provided that higher condensable hydrocarbons are present in addition to dust in the distillation gas that is generated. In these cases it has been found that a stable potential field can be imposed that is suitable for dust removal by electrostatic precipitation.

The temperatures at which the distillation gas is passed through the electrostatic precipitator lie between 300° and 650° C. It is preferred to use temperatures above 400° C. and the most preferable range of temperature is 470°–550° C.

The gas is passed through the precipitator with the customary range of velocities between 0.5 and 3.0 m/s. The gap width in the precipitator is in the lower portion of the customary range of 50–100 mm.

The DC voltage applied to the precipitator is brought as close as possible to the sparkover voltage in the conventional manner by slowly increasing it to the sparkover point, reducing it after the sparkover, and approaching the sparkover voltage again.

Having generally described the invention, a more complete understanding can be obtained by reference to certain specific examples, which are provided herein for purposes of illustration only and are not intended to be limiting unless otherwise specified.

By the procedure of the invention distillation gases obtained under the following conditions in the distillation of Schandalah oil shale were cleaned. The temperatures were 350°–550° C.; the gap width was 65 mm, and the average voltage was 30,000 V with a dust load of 6–11 g/m$^3$N, and a degree of separation of at times more than 85%. When using the process of this invention, the temperature of the precipitator should be kept high enough so that there is no oil condensation. If some oil is allowed to condense, the plates may become coated with oil. This oil film is electrically conducting possibly via the precipitated dust, and can cause short circuits on the insulation. This problem can be counteracted by additional heating of the insulators.

Having now fully described the invention, it will be apparent to one of ordinary skill in the art that many changes and modifications can be made thereto without departing from the spirit or scope of the invention as set forth herein.

What is claimed as new and desired to be protected by Letters Patent of the United States is:

1. A process for removing dust free of condensed higher hydrocarbon materials from distillation gases containing condensable higher hydrocarbon materials comprising subjecting said distillation gases to electrostatic precipitation at a temperature above the dew point of said condensable higher hydrocarbon materials.

2. The process of claim 1, wherein said electrostatic precipitation is conducted at a temperature above 300° C.

3. The process of claim 1, wherein said electrostatic precipitation is conducted at a temperature above 350° C.

4. The process of claim 1, wherein said electrostatic precipitation is conducted at a temperature between 470° C. and 550° C.

* * * * *